US010975601B2

(12) United States Patent
Beck et al.

(10) Patent No.: US 10,975,601 B2
(45) Date of Patent: Apr. 13, 2021

(54) DOOR HANDLE ASSEMBLY FOR A MOTOR VEHICLE

(71) Applicant: Huf Huelsbeck & Fuerst GmbH & Co. KG, Velbert (DE)

(72) Inventors: Andreas Beck, Bochum (DE); Serdal Bitirim, Velbert (DE); Dirk Mueller, Essen (DE); Martin Witte, Ahaus (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 541 days.

(21) Appl. No.: 15/744,662

(22) PCT Filed: Jul. 4, 2016

(86) PCT No.: PCT/EP2016/065645
§ 371 (c)(1),
(2) Date: Jan. 12, 2018

(87) PCT Pub. No.: WO2017/009078
PCT Pub. Date: Jan. 19, 2017

(65) Prior Publication Data

US 2018/0209182 A1 Jul. 26, 2018

(30) Foreign Application Priority Data

Jul. 13, 2015 (DE) ..... 102015111311.2
Oct. 29, 2015 (DE) ..... 102015118523.7
(Continued)

(51) Int. Cl.
*E05B 81/76* (2014.01)
*E05B 85/10* (2014.01)
*E05B 1/00* (2006.01)

(52) U.S. Cl.
CPC ..... *E05B 81/76* (2013.01); *E05B 1/0015* (2013.01); *E05B 81/77* (2013.01); *E05B 85/10* (2013.01)

(58) Field of Classification Search
CPC ..... E05B 85/10; E05B 85/103; E05B 1/00; E05B 85/107; E05B 85/12; E05B 85/13;
(Continued)

(56) References Cited

U.S. PATENT DOCUMENTS 6,588,813 B1 * 7/2003 Marcarini ..... E05B 85/16 292/336.3
6,648,493 B2 * 11/2003 Klein ..... B60Q 1/2669 362/100
(Continued)

FOREIGN PATENT DOCUMENTS

DE 202009009861 U1 10/2009
DE 202015102480 U1 7/2015
(Continued)

OTHER PUBLICATIONS

Machine Translation of FR 2217784, 2020, pp. 1-3 (Year: 2020).*
(Continued)

*Primary Examiner* — Christine M Mills
(74) *Attorney, Agent, or Firm* — Honigman LLP; Brandon C. Griffith; Jonathan P. O'Brien

(57) ABSTRACT

A vehicle door handle with a handle component is provided. The handle component includes a hollow body, and an inductive sensor device is arranged in a cavity in order to detect an actuation of the handle component. A support having a support fastening section and a self-supporting section connected to the latter are arranged in the cavity, wherein the support fastening section is secured to the vehicle door handle, and wherein the self-supporting section of the support extends in the interior of the cavity at a
(Continued)

Figure 1A:
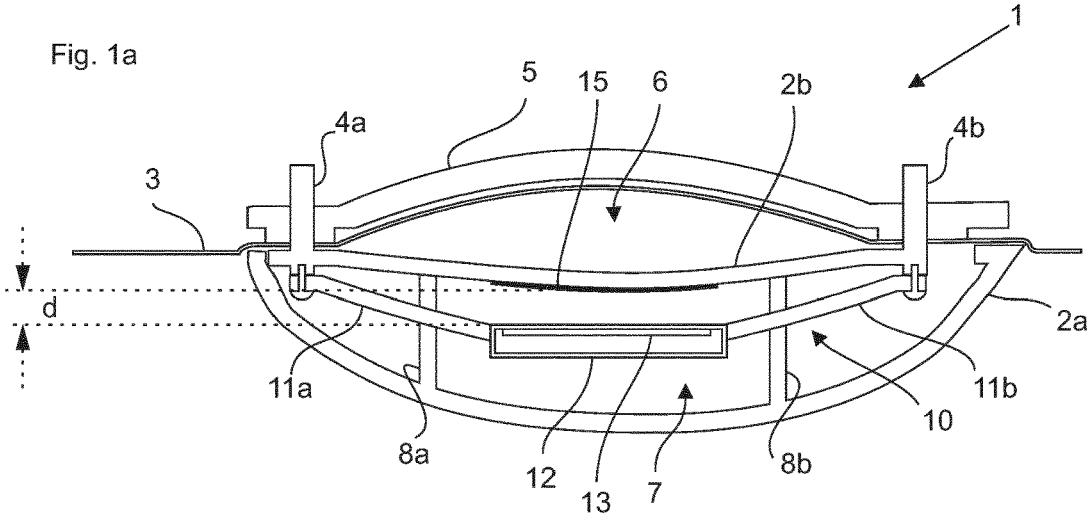

distance from the wall surfaces of the handle component such that the self-supporting section of the support is mechanically decoupled from the wall surfaces of the handle component. The inductive sensor device is held in the self-supporting section, wherein a metallic material is arranged in at least one section of those wall surfaces of the handle component which surround the self-supporting section.

10 Claims, 1 Drawing Sheet

(30) Foreign Application Priority Data

Oct. 29, 2015 (DE) ..... 102015118525.3
Dec. 18, 2015 (EP) ..... 15201091.4

(58) Field of Classification Search
CPC ..... E05B 85/14; E05B 85/16; E05B 85/18; E05B 81/76; E05B 81/77; Y10T 292/57; Y10S 292/63
USPC ..... 292/336.3, DIG. 63
See application file for complete search history.

(56) References Cited

U.S. PATENT DOCUMENTS 6,740,834 B2 * 5/2004 Sueyoshi ..... B60R 25/246 200/293.1
6,998,968 B2 * 2/2006 Garnault ..... E05B 81/78 340/426.28
7,029,054 B2 * 4/2006 Kobayashi ..... E05B 79/06 296/1.02
7,057,124 B2 * 6/2006 Ieda ..... E05B 81/76 200/520
7,192,285 B2 * 3/2007 Makino ..... E05B 81/78 200/600
7,199,317 B2 * 4/2007 Ieda ..... E05B 81/78 200/600
7,559,120 B2 * 7/2009 Fujiwara ..... B29C 45/14639 16/412
7,597,364 B2 * 10/2009 Muneta ..... B60R 25/246 292/336.3
7,751,664 B2 * 7/2010 Ieda ..... B60Q 1/2669 250/216
7,931,314 B2 * 4/2011 Nitawaki ..... B60R 25/246 292/336.3
7,984,938 B2 * 7/2011 Tanimoto ..... E05B 81/78 292/336.3
8,403,384 B2 * 3/2013 Ieda ..... B60R 25/246 292/336.3
8,408,610 B2 * 4/2013 Ieda ..... E05B 81/78 292/1
8,416,092 B2 * 4/2013 Witte ..... E05B 81/78 292/336.3
8,454,062 B2 * 6/2013 Rohlfing ..... E05B 81/78 292/336.3
8,601,903 B1 * 12/2013 Klein ..... E05B 81/78 16/110.1
8,690,204 B2 * 4/2014 Lang ..... E05B 81/77 292/279
8,801,245 B2 * 8/2014 De Wind ..... B60Q 1/2665 362/511
9,022,435 B2 * 5/2015 Park ..... E05B 1/0007 292/217
9,033,379 B2 * 5/2015 Tateishi ..... E05B 85/16 292/336.3
9,156,335 B1 * 10/2015 Harter ..... E05B 81/76
9,193,309 B2 * 11/2015 Toyama ..... B60R 13/00
9,353,557 B2 * 5/2016 Sanborn ..... E05B 85/14
9,416,565 B2 * 8/2016 Papanikolaou ..... E05B 77/28
9,834,964 B2 * 12/2017 Van Wiemeersch .... E05B 85/14
9,903,142 B2 * 2/2018 Van Wiemeersch .... E05B 81/76
9,957,737 B2 * 5/2018 Patel ..... E05B 81/76
9,988,829 B2 * 6/2018 Guibbert ..... E05B 81/77
9,995,065 B2 * 6/2018 Witte ..... E05B 85/16
10,139,514 B2 * 11/2018 Guibbert ..... E05B 81/78
10,207,633 B2 * 2/2019 Takahashi ..... E05B 17/10
10,385,595 B2 * 8/2019 Witte ..... G07C 9/00174
10,424,835 B2 * 9/2019 Ueda ..... H01Q 1/3283
10,662,682 B2 * 5/2020 Beck ..... E05B 81/77
2002/0005016 A1 * 1/2002 Menke ..... E05B 81/76 49/503
2003/0009855 A1 * 1/2003 Budzynski ..... E05B 85/10 16/443
2003/0029210 A1 * 2/2003 Budzynski ..... E05B 85/10 70/278.1
2007/0227203 A1 * 10/2007 Weber ..... E05B 81/78 70/91
2011/0012378 A1 * 1/2011 Ueno ..... E05B 81/78 292/336.3
2012/0019014 A1 * 1/2012 Tateishi ..... E05B 85/16 292/336.3
2012/0133159 A1 * 5/2012 Tateishi ..... E05B 81/77 292/336.3
2012/0133563 A1 * 5/2012 Naka ..... E05B 81/77 343/713
2014/0246873 A1 * 9/2014 Raulin ..... E05B 81/78 292/336.3
2014/0292004 A1 * 10/2014 Ruse ..... E05B 85/10 292/336.3
2015/0337571 A1 * 11/2015 Henderson ..... G07C 9/37 701/49
2016/0251880 A1 * 9/2016 Bingle ..... E05B 81/76 701/49
2017/0030119 A1 * 2/2017 Usui ..... E05B 85/10
2017/0074009 A1 * 3/2017 Banter ..... E05B 81/77
2017/0159332 A1 * 6/2017 Beck ..... E05B 85/16
2017/0306662 A1 * 10/2017 Och ..... E05B 81/78
2019/0017302 A1 * 1/2019 Beck ..... E05B 81/77
2019/0390487 A1 * 12/2019 Spick ..... E05B 81/77
2020/0011096 A1 * 1/2020 Leonardi ..... E05B 81/78

FOREIGN PATENT DOCUMENTS

EP 0584499 A1 3/1994
FR 2217784 A1 * 9/1974 ..... E05B 81/76
WO WO-0140607 A1 6/2001
WO WO-2008028839 A1 * 3/2008 ..... E05B 81/78

OTHER PUBLICATIONS

European Patent Office as The International Searching Authority, International Search Report for PCT Application No. PCT/EP2016/065645, dated Sep. 26, 2016.
European Patent Office as The International Searching Authority, Written Opinion for PCT Application No. PCT/EP2016/065645, dated Sep. 26, 2016.

* cited by examiner

DOOR HANDLE ASSEMBLY FOR A MOTOR VEHICLE

CROSS-REFERENCE TO RELATED APPLICATIONS

This application claims priority under 35 U.S.C. § 371 to Patent Cooperation Treaty Application No. PCT/EP2016/065645, filed Jul. 4, 2016, which claims priority to DE Application No. 102015111311.2, filed Jul. 13, 2015, and to DE Application No. 102015118523.7, filed Oct. 29, 2015, and to DE Application No. 102015118525.3, filed Oct. 29, 2015, and to EP Application No. 15201091.4, filed Dec. 18, 2015, the entire contents of which are incorporated herein by reference.

The invention relates to a vehicle door handle assembly. In particular, the invention relates to an exterior door handle assembly with a stationary handle and a sensor unit for detecting an actuation of the handle.

As part of the overall door handle assembly, exterior door handles have handles that a user can grasp around or behind. It is thus possible for the user to exert force on the handle in order to open or close the door or to move the door through its pivoting range. Vehicle door handles are provided with coupling means that permit the vehicle door handle to be mounted on the vehicle door.

Vehicle door handles of this type are known and available in a variety of designs. The invention, however, relates to the subgroup of vehicle door handles with a so-called stationary handle. Whereas with movable handles, a handle part of the vehicle door handle assembly that is to be grasped under or behind by a user is pivoted or moved in translatory fashion through the exertion of force, with stationary door handles, the handle cannot be pivoted or moved in translatory fashion. In door handles with a stationary handle, the handle is largely stationary relative to the door. In door handles with stationary handles, since there is no mechanical movement path, no direct mechanical action chain from the door handle to a door lock is produced. Instead, the door lock is triggered electrically as a function of a detected actuation so that it is possible to reduce the amount of mechanical hardware and to achieve savings with regard to costs and weight of the door handle assembly.

Such stationary handles and vehicle door handle assemblies are usually used in combination with electrically triggered door locks. Such electrically triggered door locks are generally known by the term "e-latch." Another example of such a door system is described in EP 0,584,499 A1.

The way in which vehicle door handle assemblies with stationary handles detect the actuation of the handle is embodied in various ways in the prior art. Switches or capacitive sensors can be used on or in the vehicle door handle. It is also possible to use inductive sensors and this is also done in the context of the present invention.

Inductive sensors for this purpose are available on the market and generally function by means of a resonant circuit, which produces eddy currents in adjacent electrically conductive materials. The amplitude of the resonant circuit changes as a function of the position and movement of the electrically conductive material relative to the resonant circuit. This amplitude change can be detected and recorded for actuation recognition. The market for inductive sensors of this kind is correspondingly large. For example, there are also known sensors that are particularly suitable for use in door handles because of their compact design and low weight, for example sensors of the LDC series made by the Texas Instruments Company.

The handle of a vehicle door handle of this generic type is embodied in at least some sections as a hollow body with a cavity. The cavity is delimited by the wall surfaces of the handle. An inductive sensor unit is positioned in the cavity in order to detect an actuation of the handle.

The object of the invention is to achieve a particularly lightweight, reliable and inexpensive-to-manufacture door handle assembly with a stationary handle.

This object is attained by means of a vehicle door handle assembly with the features of claim 1.

Like the generically described vehicle door handles, the novel door handle also has a handle that can be grasped around or from behind. The vehicle door handle has coupling means that include an attachment of the vehicle door handle to the door. The coupling means in this case can also be embodied directly on the handle. The handle is embodied as a hollow body in at least some sections. The hollow body with the handle is delimited all around by wall surfaces of the handle. An inductive sensor unit is positioned in the cavity in order to detect an actuation of the handle.

As described above, inductive sensor units are suitable for detecting movements, displacements, or rotations of electrically conductive objects in their vicinity. The important thing in this connection is that a relative movement occurs between the detecting sensor unit and the electrically conductive object, for example a metallic object. According to the invention, the detection is improved and facilitated in that a support is provided in the cavity inside the handle. This support has at least one support-fastening section and a floating section connected to this support-fastening section. The support-fastening section is affixed to the vehicle door handle. This means that the support-fastening section is affixed to any component of the overall vehicle door handle assembly, which also includes an attachment to the handle.

The floating section of the support, which is secured by the support-fastening section, extends in the cavity of the handle spaced apart from the wall surfaces. This means that the floating section of the support is mechanically decoupled from the surrounding wall surfaces of the cavity since it is in fact held and affixed by the support-fastening section, but is itself spaced apart from the wall surfaces. The floating section is thus held between the inner wall surfaces of the cavity so to speak. The floating section can, for example, be positioned so that it protrudes into the cavity starting from the support-fastening section; it can also bridge across a region of the cavity between a plurality of support-fastening sections.

The inductive sensor unit is secured in this floating section of the support. A metallic material is positioned in at least one section of the wall surfaces of the cavity that surrounds the floating section.

The sensor unit is thus secured to the floating section inside the cavity, spaced apart from the wall surfaces. In or on the spaced-apart wall surfaces or a section thereof, the metallic material can be detected by means of the sensor unit. Because of the mechanical decoupling of the floating section in the cavity, it is possible to detect a relative displacement of the metallic material in the surrounding wall surfaces. The displacement or deformation of the wall surfaces relative to the sensor unit can be detected in a particularly reliable and sensitive fashion since a mechanical decoupling is provided. This is achieved because the support-fastening section to which the floating section is secured is mounted in a region that is not deformed or moved at all when an actuation occurs or is only deformed or moved slightly. If the handle element of the door handle is actuated, for example by pushing or pulling the door handle, then the outer wall can move slightly relative to the section with the inductive sensor unit that is secured in floating fashion on the inside. The sensor unit detects the relative movement in a sensitive fashion.

The important thing is that the floating design of a section of the support and the floating support of the sensor unit achieve an improved decoupling between movements of the sensor unit and those of the surrounding walls. In order to achieve this, the fastening section of the support must, if possible, be mounted in a section of the handle or of the vehicle door handle assembly in general, which, when an actuation occurs, is influenced significantly less than the walls of the handle.

In a preferred embodiment of the invention, the handle is embodied as an elongated body, with the cavity extending along the greatest longitudinal span of the handle in a middle section inside the handle. The support-fastening section is affixed in an off-center fashion relative to the middle section in the direction of this longitudinal span.

In other words, in this exemplary embodiment, with an elongated handle, the floating section is supported in floating fashion in the middle section that is to be actuated, with the support-fastening section being affixed adjacent to the middle section or in an end region of the middle section. As a result, the sensor unit is suspended in the floating in the middle section that is to be actuated, but the suspension mount is affixed laterally thereto in an end section of the handle or at least laterally to the middle section. If the middle section is deformed by a user, for example by pulling on the door handle, then this deformation takes place in the region surrounding the sensor unit and thus in a detectable way. The location of the suspension mount, however, is hardly influenced at all by the actuation since it is provided at a position that is laterally offset from the actuation region.

It is advantageous if respective support-fastening sections are positioned at ends of the floating section of the support that are oriented away from each other.

In this embodiment, a plurality of support-fastening sections is provided, for example at two ends of a floating section that are oriented away from each other. Like a bridge with two lateral points, this support design can ensure the fastening while the middle part, the floating section, supports the sensor unit so that it is spaced apart from the surrounding walls and bridges across a section of the cavity.

In a modification of the invention, the support-fastening section for the attachment to the vehicle door handle is connected to the coupling means of the vehicle door handle. In this embodiment, the mounting points that serve to affix the overall door handle assembly to the vehicle are also used to affix the support. This therefore produces a particularly stable, low-deformation suspension and fastening of the support structure in the door handle.

It is particularly preferable if the support-fastening sections extend laterally at an angle or in a curved fashion from a floating section positioned between them and are affixed on the inside of the handle at points that are spaced apart from each other so that the floating section is clamped between these points in the cavity and is secured in a floating fashion. By means of the support structure, the space between the mounting points is once again bridged over in the same way as with a bridge structure and whereas the middle part is spaced apart from the surrounding walls and is largely mechanically decoupled from them, the mounting points ensure a secure and stable holding of the sensor unit in the clamped floating section. A curvature or angling can also contribute to a further decoupling of handle deformations from the position of the floating section.

It is preferable if a metallic material in the form of a metallic layer is provided on a section of the inside of the walls of the handle in the cavity.

The inside of the handle is particularly close to the sensor unit and as a result, when the walls of the handle are deformed, this can be detected in a particularly sensitive way. The metallic layer can be embodied in the form of paint, a foil coating, or some other metallic layer material.

It is particularly advantageous if the floating section has a trough-like structure into which the sensor unit can be inserted. In such a trough-like recess, the sensor unit—for example positioned on a board and connected to it—is accommodated in a particularly secure fashion and is locked in position. It is also particularly advantageous if the sensor unit is encased in a casting compound in the trough-like recess. This prevents the sensor unit from moving or wiggling in the recess.

In a modification of the invention, connecting support contours are provided on the inside of the handle, between the walls of the handle in the region of the cavity. These support contours or support structures provide mutual support to wall sections situated opposite each other. As a result of this, a force and deformation that have been exerted on one of the walls are transmitted to another wall through a transmission of force by the support contours. For example, based on the assumption of a two-shelled design of the handle, with one shell oriented toward the vehicle in the region of the side facing the body panel of the vehicle and with a covering shell on the visible side, then this embodiment with support contours means that a pulling actuation on the side of the handle facing the vehicle can also produce a deformation on the visible side of the handle. By means of the support structures, a pushing on the visible side of the handle imparts a deformation on the side of the handle facing the vehicle.

This can be advantageously used so that a metallic structure such as a metallic foil is provided on only one side of the inside of the handle. Depending on whether a pulling force is exerted from one side of the handle or a pushing force is exerted from the other side of the handle, the transmission of force by the support structures causes the metallic foil to move in any case. Since the sensor assembly is secured inside the handle in floating fashion between the walls, in one direction, the metallic structure moves away from the sensor assembly and in the other direction, it moves toward the sensor assembly. The use of the support structures therefore makes it possible to detect both a pushing force exerted on one side of the handle and a pulling force exerted on the other side of the handle with the provision of just one metallic element and one sensor assembly.

The invention will now be explained in greater detail based on the accompanying drawings.

Figure 1B:
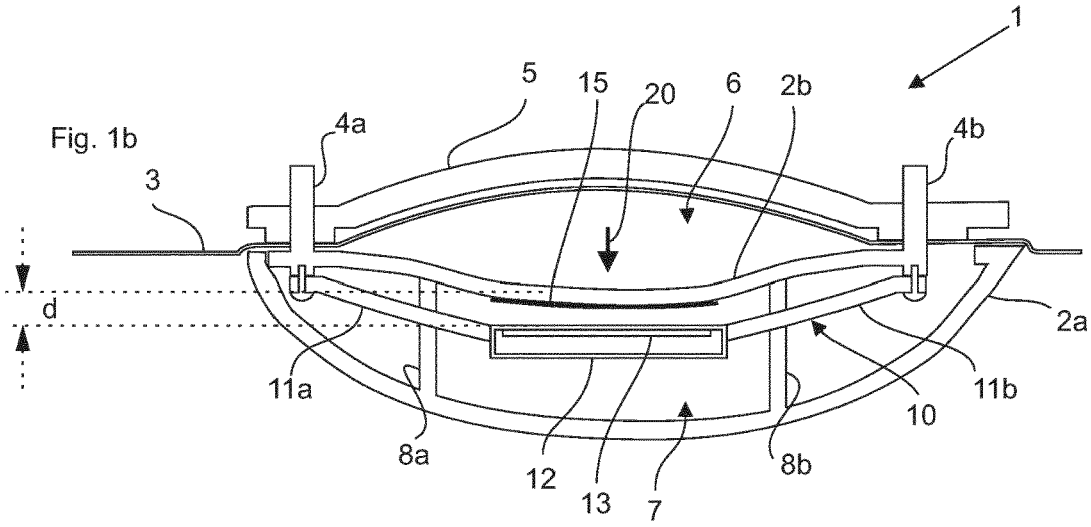
Figure 1C:
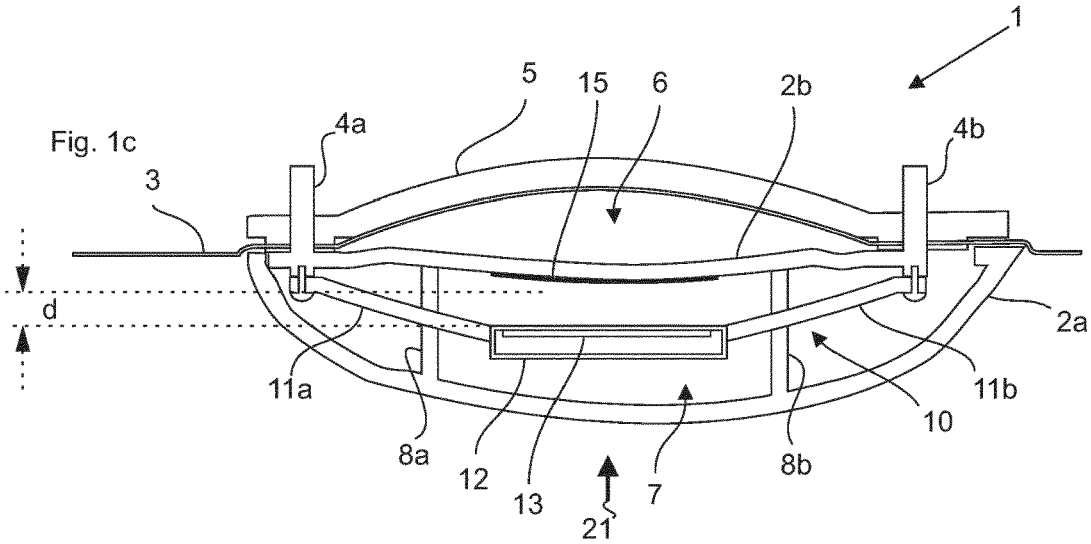

FIG. 1*a* shows an embodiment of the door handle assembly according to the invention in a rest position;

FIG. 1*b* shows the embodiment from FIG. 1*a* during a pulling actuation; and FIG. 1*c* shows the embodiment from FIG. 1*a* during a pushing actuation.

FIG. 1*a* shows an embodiment of the door handle assembly 1. The door handle assembly has a handle, which is composed of two handle shells 2*a*, 2*b*. The two handle shells 2*a*, 2*b* form an enclosed elongated space. FIG. 1*a* shows a section extending parallel to the longitudinal axis of the handle. The handle is positioned on a door, on the outside of a door panel 3. Projections 4*a*, 4*b*, which constitute coupling means for affixing the door handle assembly to the vehicle, protrude through the door panel 3. On the inside of the door panel 3 (shown at the top in FIG. 1*a*), an internal support 5 for the door handle assembly is installed, which is engaged by the fastening means 4*a* and 4*b*, for example by means of a screw connection or detent engagement means.

Between the door panel 3 and the outwardly curved shell 2*b* of the handle, a grasping space 6 is provided. The hand of a user can be inserted into this grasping space and can exert a pulling force on the inside of the handle. A cavity 7 is formed on the inside of the shells 2*a*, 2*b* of the handle. Extending through the cavity 7, there are support structures 8*a*, 8*b*, which in this exemplary embodiment, are embodied as integrally joined to the shell 2*a*. The support structures 8*a* and 8*b* extend through the cavity 7 to the opposite inside of the shell 2*b* and are supported there. In this way, through the transmission of force by the support structures 8*a* and 8*b*, a deformation of one of the shells 2*a* or 2*b* in the middle section is transmitted to the respective other shell.

A support 10 also extends in the longitudinal direction through the cavity 7. The support 10 has support-fastening sections 11*a*, 11*b* at both ends. These support-fastening sections are attached to the fastening means 4*a* and 4*b*. Between the support-fastening sections 11*a*, 11*b*, a floating section 12 is embodied in the form of a trough in which the sensor assembly 13 is accommodated. The floating section 12 is secured in bridge fashion between the support-fastening sections 11*a* and 11*b* and is positioned spaced apart and decoupled from the middle region of the shells 2*a* and 2*b*.

The sensor assembly 13 in the floating section 12 therefore lies along the longitudinal axis of the handle assembly, approximately in the middle, mechanically decoupled from the shells 2*a* and 2*b*. On the shell 2*b*, in the region that corresponds to the middle section, a metal foil 15 is glued to the inside of the shell 2*b*. The metal foil 15 is correspondingly situated opposite from the sensor assembly 13, but is separated from it by an air gap. The inductive sensors of the sensor assembly 13 detect the distance of the metal foil 15. A change in the position of the metal foil 15 relative to the sensor assembly 13 results in a signal change. In addition, the sensor assembly 13 is connected to supply lines and signal lines, but they are not shown here for the sake of clarity.

In the rest position in FIG. 1, the distance between the metal foil 15 and the sensor assembly 13 is indicated by the distance d in FIG. 1*a*. This distance defines a rest position and the inductive sensors send a corresponding rest signal to the sensor assembly 13.

FIG. 1*b* shows an actuation of the door handle assembly. To accomplish this, a user reaches into the intermediate space 6 and by exerting a pulling force (indicated by the arrow 20), deforms the shell 2*b* in the region in which the metal foil 15 is mounted. The deformation is depicted in exaggerated fashion here in order to clearly show the function. Since the sensor unit 13 in the floating support section 12 is to a large extent mechanically decoupled from the shell 2*b*, the sensor assembly does not move along with it, but the metal foil 15 comes closer to the sensor assembly 13. This is apparent because the rest position distance d is once again shown with dashed lines in FIG. 1*b*, making it clear that this rest position distance has been exceeded. Correspondingly, the inductive sensors detect the approach of the metal foil 15 to the sensor assembly 13. The deformation of the handle shell 2*b* has hardly any effect on the position of the support 10 since the latter is affixed offset from the middle section and in fact in this exemplary embodiment, to the fastening means 4*a*, 4*b* that fasten the entire handle to the door panel 3.

FIG. 1*c* shows the case of an actuation in which a pushing force is exerted on the handle from the outside. This can occur, for example, in order to confirm that the user wishes to close the door. The rest position distance d is once again depicted with dashed lines in FIG. 1*c*.

The action of the support structures 8*a* and 8*b* is particularly apparent in this example. The pushing on the outer surface first deforms the shell 2*a*. By means of the support structures 8*a* and 8*b*, force is introduced into the shell 2*b* since the support structures 8*a* and 8*b* rest on this shell. As a result, the shell 2*b* is deformed in the direction of the arrow 21 and the metal foil 15 moves away from the sensor assembly 13. Once again, the deformation does not affect the support 10 since the latter, together with its floating section 12, is mechanically decoupled from the deformed regions. The support is in particular also entirely decoupled from the support structures 8*a* and 8*b*; the latter can extend past the support 10 or can extend through openings in the support, without mechanical contact.

This embodiment makes it possible by means of a single sensor assembly 13 to detect both the pulling of the door handle according to FIG. 1*b* and a pushing on the door handle according to FIG. 1*c*. In reality, the deformations are much smaller than the deformations shown in FIGS. 1*b* and 1*c*, but they have been depicted in exaggerated fashion in order to illustrate the invention.

In modifications of the invention, instead of a metal foil, it is also possible for the metallic element to be provided in the form of a chrome plating of the door handle. Alternatively, the material of the handle shells can also be equipped with metallic particles or regions in order to influence the inductive sensors of the sensor assembly 13.

The invention claimed is:

1. A vehicle door handle assembly for placement on a vehicle door, the vehicle door handle assembly comprising:

a handle, which a user can grasp behind;

a coupler for attaching the vehicle door handle assembly to the door, the handle including a hollow body having a cavity delimited by wall surfaces of the handle;

at least one inductive sensor unit positioned in the cavity to detect an actuation of the handle;

a support disposed in the cavity, the support having at least one support-fastening section and a floating section connected thereto, the at least one support-fastening section affixed to the vehicle door handle assembly, and the floating section of the support extending inside the cavity spaced apart from the wall surfaces of the handle so that the floating section of the support is mechanically decoupled from the wall surfaces of the handle; and connecting support contours disposed between the wall surfaces of the handle in a region of the cavity, the connecting support contours supporting opposing regions of the handle relative to each other so that upon a transmission of force, a deformation of the handle is transmitted by the connecting support contours to an opposing region of the handle, wherein the at least one inductive sensor unit is secured in the floating section of the support, wherein at least one section of the wall surfaces, which surround the floating section, includes a metallic material, and wherein the connecting support contours extend from a first wall surface of the handle, through the support, and to a second wall surface of the handle, the second wall surface opposing the first wall surface.

2. The vehicle door handle assembly according to claim 1, wherein the handle includes an elongated body and wherein the cavity extends along a greatest longitudinal span in a middle section on an inside of the handle and wherein the at least one support-fastening section is affixed off-center relative to the middle section in the direction of the greatest longitudinal span.

3. The vehicle door handle assembly according to claim 1, wherein the at least one support-fastening section includes a first support-fastening section disposed at a first end of the floating section of the support and a second support-fastening section disposed at a second end of the floating section of the support, the first and second support-fastening sections oriented away from each other.

4. The vehicle door handle assembly according to claim 3, wherein the first support-fastening section for the attachment to the vehicle door handle assembly is connected to the coupler.

5. The vehicle door handle assembly according to claim 3, wherein the first and second support-fastening sections extend laterally at an angle or arcuately from the floating section and are affixed on an inside of the handle at points that are spaced apart from each other so that the floating section is clamped between the points in the cavity and is secured in a floating fashion.

6. The vehicle door handle assembly according to claim 1, wherein the metallic material forms a metallic layer on a section of an inside of the handle in the cavity.

7. The vehicle door handle assembly according to claim 6, wherein the metallic layer is a metal foil.

8. The vehicle door handle assembly according to claim 1, wherein the floating section of the support has a trough-shaped recess, and wherein the at least one inductive sensor unit is disposed in the trough-shaped recess.

9. The vehicle door handle assembly according to claim 8, wherein the at least one inductive sensor unit is encased in a casting compound in the trough-shaped recess.

10. The vehicle door handle assembly according to claim 1, wherein upon transmission of force to the handle, a deformation of the handle is not transmitted by the support contours to the floating section.

* * * * *